US006379228B2

(12) United States Patent
Matsumoto

(10) Patent No.: US 6,379,228 B2
(45) Date of Patent: Apr. 30, 2002

(54) POLISHING MACHINE HAVING A PLURALITY OF ABRASIVE PADS

(75) Inventor: Muneyuki Matsumoto, Kyoto (JP)

(73) Assignee: Rohm Co., LTD, Kyoto (JP)

( * ) Notice: Subject to any disclaimer, the term of this patent is extended or adjusted under 35 U.S.C. 154(b) by 0 days.

(21) Appl. No.: 09/728,116

(22) Filed: Dec. 4, 2000

(30) Foreign Application Priority Data

Dec. 9, 1999 (JP) ..... 11-350463

(51) Int. Cl.[7] ..... B24B 7/00

(52) U.S. Cl. ..... 451/66; 451/41; 451/287; 451/288; 451/289

(58) Field of Search ..... 451/41, 60, 287, 451/288, 289

(56) References Cited

U.S. PATENT DOCUMENTS 5,951,373 A * 9/1999 Shendon et al. ..... 451/41
6,116,994 A * 9/2000 Ito et al. ..... 451/288
6,193,587 B1 * 2/2001 Lin et al. ..... 451/56

* cited by examiner

*Primary Examiner*—Joseph J. Hail, III
*Assistant Examiner*—Shantese McDonald
(74) *Attorney, Agent, or Firm*—Arent Fox Kintner Plotkin & Kahn, PLLC

(57) ABSTRACT

A polishing machine provided with a plurality of bases operative independently of each other; a plurality of abrasive pads respectively fixed to the plurality of bases and each having an abrasive surface for polishing a workpiece; and a base driving mechanism for individually operating the plurality of bases. The operations of the respective bases are individually controlled by controlling the base driving mechanism by means of a control circuit. The control circuit controls the base driving mechanism so that the workpiece is generally uniformly polished by the abrasive surfaces of the respective abrasive pads.

12 Claims, 5 Drawing Sheets

POLISHING MACHINE HAVING A PLURALITY OF ABRASIVE PADS

BACKGROUND OF THE INVENTION

1. Field of the Invention

The present invention relates to a polishing machine for polishing a workpiece such as a wafer.

2. Description of Related Art

A semiconductor device production process often employs a polishing process such as a CMP (chemical mechanical polishing) process. After an inter-level dielectric film and copper interconnections are formed on a surface of a wafer, for example, the CMP process is performed for planalization of surfaces of the inter-level dielectric film and the copper interconnections.

The schematic construction of a prior-art polishing machine is diagrammatically shown in FIG. 6. The polishing machine comprises: a wafer carrier 91 to be driven to be rotated about a vertically extending rotation axis thereof while holding a wafer W face down by suction; a polishing plate 92 provided below the wafer carrier 91 in an opposed relation thereto; and a nozzle 93 for supplying an abrasive agent to the polishing plate 92. The polishing plate 92 includes a generally circular base 94 having a greater size than the wafer W as viewed in plan and an abrasive pad 95 fixed to an upper surface of the base 94, and is adapted to be driven to be rotated about a vertically extending rotation axis thereof.

With this arrangement, a load is applied downward to the wafer carrier 91 to press the wafer W against the abrasive pad 95. In this state, the wafer carrier 91 and the polishing plate 92 are driven to be rotated while the abrasive agent is supplied onto the upper surface of the abrasive pad 95 from the nozzle 93. Thus, the surface of the wafer W (opposed to the polishing plate 92) can be polished.

The abrasive pad 95 rotated with the polishing plate 92 has different moving speeds at different positions thereof, depending on a radial distance from the center of the rotation of the abrasive pad 95 (polishing plate 92). Similarly, the wafer W rotated with the wafer carrier 91 has different moving speeds at different positions thereof, depending on a radial distance from the center of the wafer W. Therefore, the moving speed of the abrasive pad 95 relative to the different positions of the wafer W is not uniform, resulting in nonuniform polishing rate over the surface of the wafer W.

SUMMARY OF THE INVENTION

It is an object of the present invention to provide a polishing machine which is capable of uniformly polishing a workpiece.

A polishing machine according to the present invention comprises: a plurality of bases operative independently of each other; a plurality of abrasive pads respectively fixed to the plurality of bases and each having an abrasive surface for polishing a workpiece; and a base driving mechanism for individually operating the plurality of bases. The polishing machine preferably further comprises a control circuit for controlling the base driving mechanism so as to individually control the operations of the respective bases.

The plurality of bases may each be adapted to be rotated about an axis extending through a center thereof, or to be swung in a circular orbit about an axis extending through a point other than the center thereof. Alternatively, the plurality of bases may be adapted to linearly move the abrasive pads fixed thereto along the abrasive surfaces.

In accordance with the invention, the operations of the respective bases are individually controlled so that the abrasive pads are moved at a uniform speed with respect to different points on the workpiece and uniformly apply a pressure onto the different points on the workpiece. Thus, the workpiece can uniformly be polished.

A polishing machine according to another aspect of the invention comprises an abrasive pad having an abrasive surface for polishing a workpiece, the abrasive pad being adapted to be rotated about an axis extending through a center of the abrasive surface with the abrasive surface kept in abutment against the workpiece for polishing the workpiece, wherein the abrasive pad is divided into a center portion including the center of the abrasive surface and a ring portion surrounding the center portion.

Where the abrasive pad is a unitary member, the workpiece is liable to be polished at nonuniform polishing rate when the abrasive pad is rotated about the axis extending through the center of the abrasive surface thereof. This is because the abrasive surface of the abrasive pad has different moving speeds at different positions thereof, depending on a radial distance from the center of the abrasive surface.

In the present invention, the abrasive pad is divided into the center portion including the center of the abrasive surface and the ring portion surrounding the center portion. Therefore, the abrasive surface of the abrasive pad can be moved at a generally uniform moving speed by individually controlling the rotation of the center portion and the rotation of the ring portion. Thus, the polishing operation can be performed at a uniform polishing rate over the workpiece.

The polishing machine may further comprise an abrasive agent supply mechanism for supplying an abrasive agent necessary for the polishing of the workpiece onto the abrasive surface of the abrasive pad. In this case, the abrasive agent supply mechanism is preferably adapted to supply the abrasive agent onto the abrasive surface of the abrasive pad through a space between the plurality of abrasive pads or through a space between the center portion and the ring portion.

The abrasive surface of the abrasive pad is preferably formed with a recess for retaining the abrasive agent supplied from the abrasive agent supply mechanism.

With this arrangement, a portion of the abrasive agent supplied to the surface of the abrasive pad from the abrasive agent supply mechanism can be retained in the recess so as to be used for the polishing operation.

The foregoing and other objects, features and effects of the present invention will become more apparent from the following description of the preferred embodiments with reference to the attached drawings.

DESCRIPTION OF THE PREFERRED EMBODIMENTS

Figure 1:
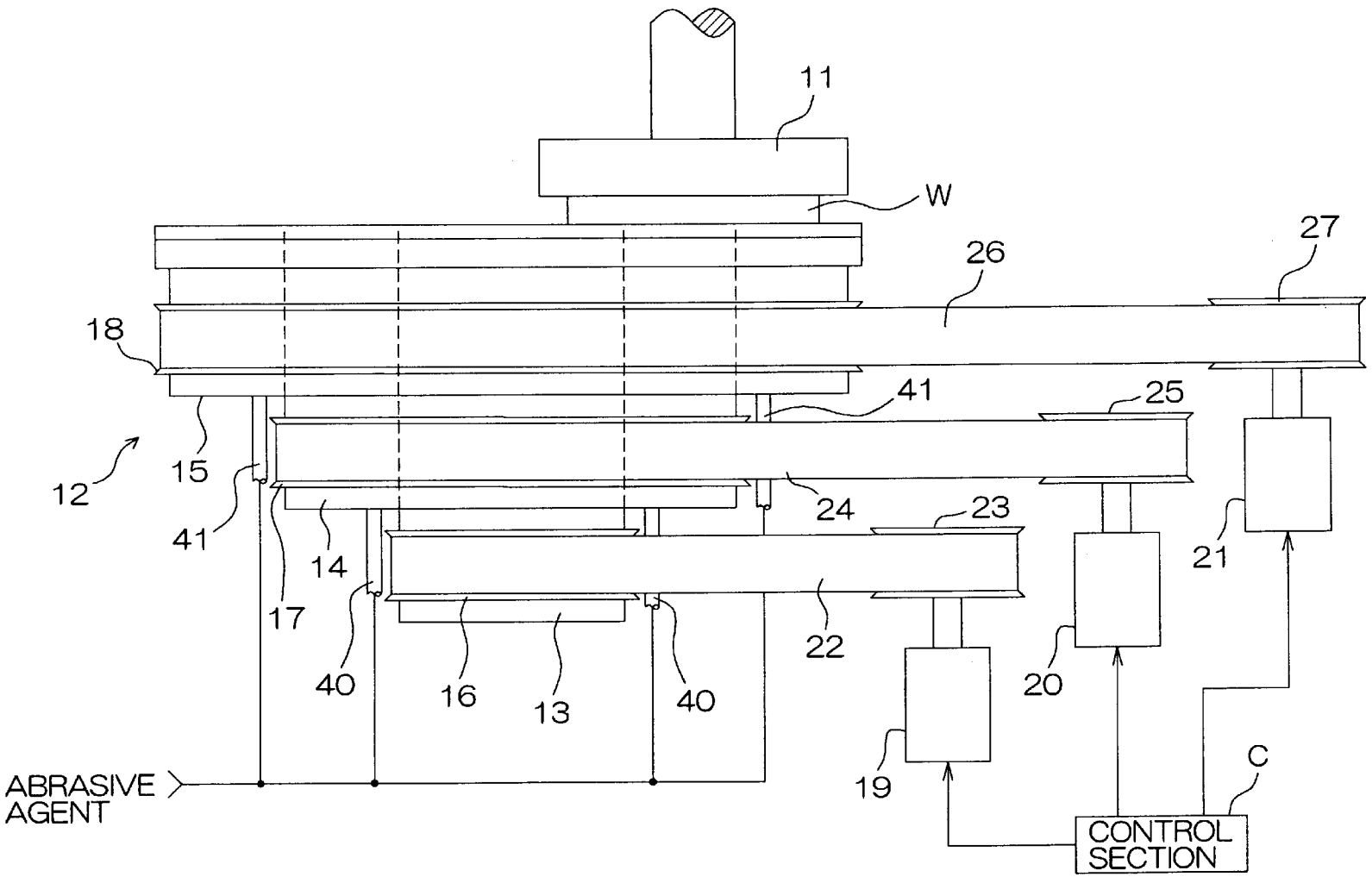
FIG. 1 is a side view diagrammatically illustrating the construction of a polishing machine according to one embodiment of the present invention.

FIG. 1 is a side view diagrammatically illustrating the construction of a polishing machine according to one embodiment of the present invention. The polishing machine, which is adapted to chemically and mechanically polish a surface of a wafer W as a workpiece, comprises a wafer carrier 11 for holding the wafer W face down by suction, and a polishing base 12 opposed to the wafer carrier 11. The wafer carrier 11 is driven to be rotated about a vertically extending rotation axis by a rotative driving mechanism not shown. The wafer carrier 11 is capable of pressing the wafer W against the polishing base 12 by a load mechanism not shown.

The polishing base 12 includes a rotatable center portion 13 of a generally cylindrical shape, a first rotatable ring portion 14 of a generally hollow cylindrical shape surrounding the rotatable center portion 13, and a second rotatable ring portion 15 of a generally hollow cylindrical shape surrounding the first rotatable ring portion 14. The rotatable center portion 13, the first rotatable ring portion 14 and the second rotatable ring portion 15 are supported rotatably about vertically extending rotation axes thereof. In this embodiment, the rotation axes of the rotatable center portion 13, the first rotatable ring portion 14 and the second rotatable ring portion 15 generally coincide with each other. Upper surfaces of the rotatable center portion 13, the first rotatable ring portion 14 and the second rotatable ring portion 15 are generally flush with each other, and serve as abrasive surfaces for polishing the workpiece.

The rotatable center portion 13 has a lower portion which extends downwardly of the first rotatable ring portion 14, and a pulley 16 is fixed around the lower portion of the rotatable center portion 13. The first rotatable ring portion 14 has a lower portion which extends downwardly of the second rotatable ring portion 15, and a pulley 17 is fixed around the lower portion of the first rotatable ring portion 14. Further, a pulley 18 is fixed around the second rotatable ring portion 15.

Rotational driving forces of motors 19, 20, 21 are to be respectively inputted to the pulleys 16, 17, 18 via proper transmission mechanisms. More specifically, a timing belt 22 is stretched around the pulley 16, so that the rotation of a pulley 23 fixed around a rotation shaft of the motor 19 is inputted to the pulley 16 via the timing belt 22. A timing belt 24 is stretched around the pulley 17, so that the rotation of a pulley 25 fixed around a rotation shaft of the motor 20 is inputted to the pulley 17 via the timing belt 24. A timing belt 26 is stretched around the pulley 18, so that the rotation of a pulley 27 fixed around a rotation shaft of the motor 21 is inputted to the pulley 18 via the timing belt 26.

With this arrangement, the rotatable center portion 13, the first rotatable ring portion 14 and the second rotatable ring portion 15 can be rotated independently of each other. The rotation speeds and rotational directions of the rotatable center portion 13, the first rotatable ring portion 14 and the second rotatable ring portion 15 can individually be controlled by controlling the driving of the motors 19, 20 and 21, respectively, by means of a control section C such as comprised of a microprocessor.

Figure 2:
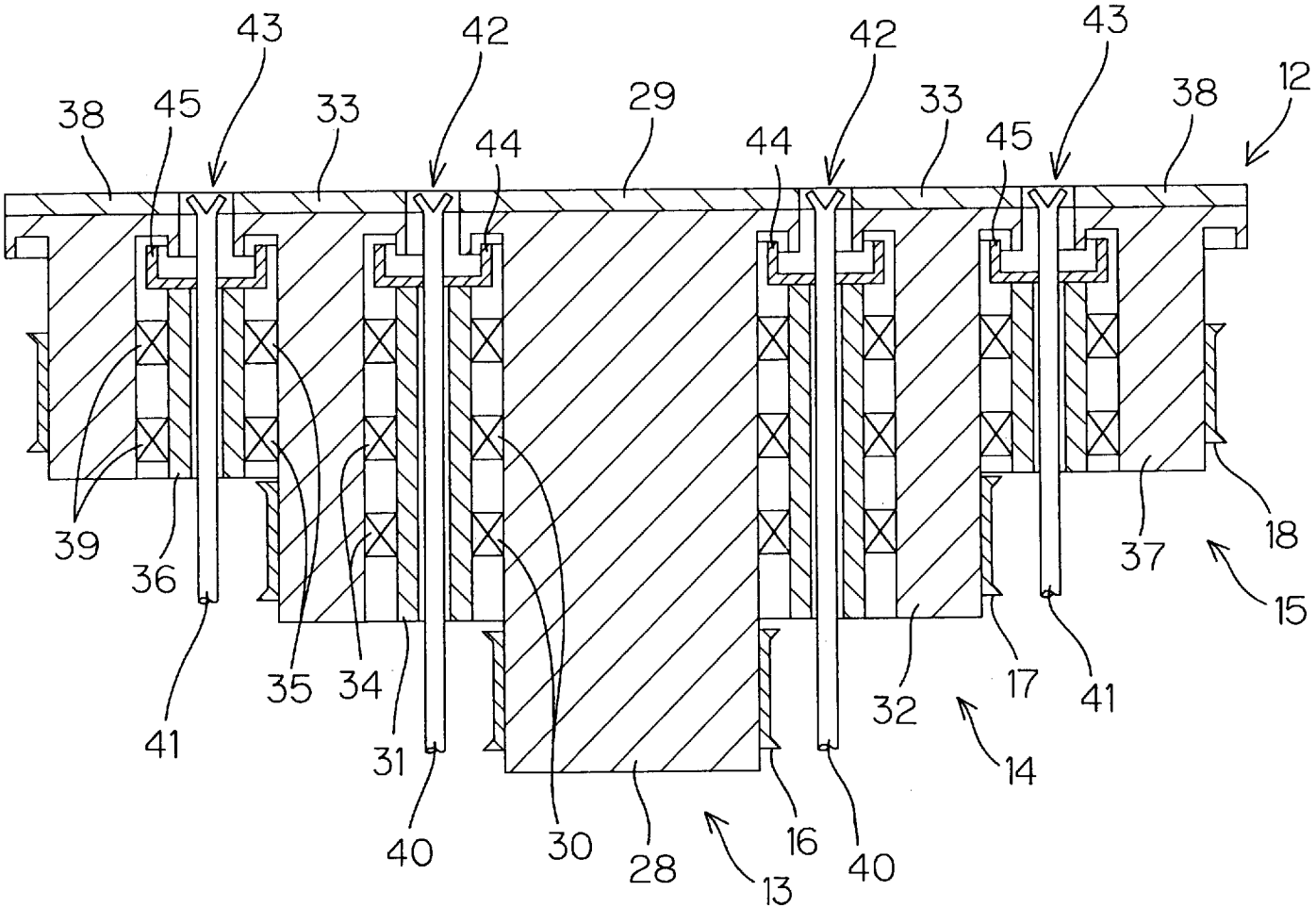
FIG. 2 is a sectional view specifically illustrating the construction of a polishing base.

FIG. 2 is a sectional view specifically illustrating the construction of the polishing base 12. The rotatable center portion 13 of the polishing base 12 includes a base 28 of a generally cylindrical shape, and an abrasive pad 29 of a thin disk shape fixed to an upper surface of the base 28. A plurality of bearings 30 are fitted around the base 28. The plurality of bearings 30 are fitted within a first stationary cylinder 31 so as to support the rotatable center portion 13 rotatably with respect to the first stationary cylinder 31.

The first rotatable ring portion 14 includes a base 32 of a generally hollow cylindrical shape, and an abrasive pad 33 of a thin ring shape fixed to an upper surface of the base 32, and is supported rotatably around the first stationary cylinder 31 via bearings 34 fitted therein. A plurality of bearings 35 are fitted around the base 32. The plurality of bearings 35 are fitted within a second stationary cylinder 36 to support the first rotatable ring portion 14 rotatably with respect to the second stationary cylinder 36.

The second rotatable ring portion 15 includes a base 37 of a generally hollow cylindrical shape, and an abrasive pad 38 of a thin ring shape fixed to an upper surface of the base 37, and is supported rotatably about the second stationary cylinder 36 via bearings 39 fitted therein.

Abrasive agent supply pipes 40 and 41 for supplying an abrasive agent from an abrasive agent tank or the like not shown extend through the first stationary cylinder 31 and the second stationary cylinder 36, respectively. The abrasive agent supply pipes 40 extending through the first stationary cylinder 31 project above an upper surface of the first stationary cylinder 31 to extend into a trench 42 defined between the rotatable center portion 13 and the first rotatable ring portion 14, and are each branched into two tip portions so that the abrasive agent from the abrasive agent tank can efficiently be supplied onto the abrasive pad 29 of the rotatable center portion 13 and onto the abrasive pad 33 of the first rotatable ring portion 14. The abrasive agent supply pipes 41 extending through the second stationary cylinder 36 project above an upper surface of the second stationary cylinder 36 to extend into a trench 43 defined between the first rotatable ring portion 14 and the second rotatable ring portion 15, and are each branched into two tip portions so that the abrasive agent from the abrasive agent tank can efficiently be supplied onto the abrasive pad 33 of the first rotatable ring portion 14 and onto the abrasive pad 38 of the second rotatable ring portion 15.

Gutters 44 and 45 each having a generally U-shaped cross section are fixed on upper edges of the first stationary cylinder 31 and the second stationary cylinder 36, respectively, so that the abrasive agent supplied onto the abrasive pads 29, 33, 38 from the abrasive agent supply pipes 40, 41 flows into the trenches 42, 43 and is received in the gutters 44, 45. A plurality of drain ports not shown are provided in each of the gutters 44, 45, so that the abrasive agent flowing into the gutters 44, 45 is drained through the drain ports.

When a polishing operation is to be performed on the wafer W, the wafer carrier 11 (see FIG. 1) is lowered to press the wafer W against the upper surfaces of the rotatable center portion 13, the first rotatable ring portion 14 and the second rotatable ring portion 15 (the surfaces of the abrasive pads 29, 33, 38). Further, the abrasive agent is supplied onto the surfaces of the abrasive pads 29, 33, 38 from the abrasive agent supply pipes 40, 41 (see FIG. 1). At the same time, the wafer carrier 11 is rotated, and the rotatable center portion 13, the first rotatable ring portion 14 and the second rotatable ring portion 15 are rotated. At this time, the rotation speeds and rotational directions of the rotatable center portion 13, the first rotatable ring portion 14 and the second rotatable ring portion 15 are individually controlled so that the abrasive pads 29, 33, 38 are moved at a generally uniform moving speed with respect to different points on the surface of the wafer W. Thus, the surface of the wafer W can substantially uniformly be polished.

Although the rotatable center portion 13, the first rotatable ring portion 14 and the second rotatable ring portion 15 are each adapted to be rotated about the vertically extending rotation axis in this embodiment, these rotatable portions 13, 14, 15 may each be adapted to be swung (or eccentrically rotated) in a circular orbit within a horizontal plane. Alternatively, only the rotatable center portion 13 may be adapted to be swung (or rotated), and the first rotatable ring portion 14 and the second rotatable ring portion 15 may be adapted to be rotated (or swung). Further, the rotatable center portion 13 and the first rotatable ring portion 14 may be adapted to be swung (or rotated), and only the second rotatable ring portion 15 may be adapted to be rotated (or swung). Still further, the rotatable center portion 13 and the second rotatable ring portion 15 may be adapted to be swung (or rotated), and only the first rotatable ring portion 13 may be adapted to be rotated (or swung). In any of these cases, the trenches 42, 43 preferably each have a sufficient width to prevent the rotatable center portion 13, the first rotatable ring portion 14 and the second rotatable ring portion 15 from bumping against one another.

The abrasive pads 29, 33, 38 may be formed of the same material, but is preferably formed of different materials for more precise control of the polishing rates at the different points on the wafer W. In this case, the uniformity in the polishing rate over the wafer W can more precisely be controlled, whereby the polishing operation can advantageously be performed on the surface of the wafer W.

Figure 3:
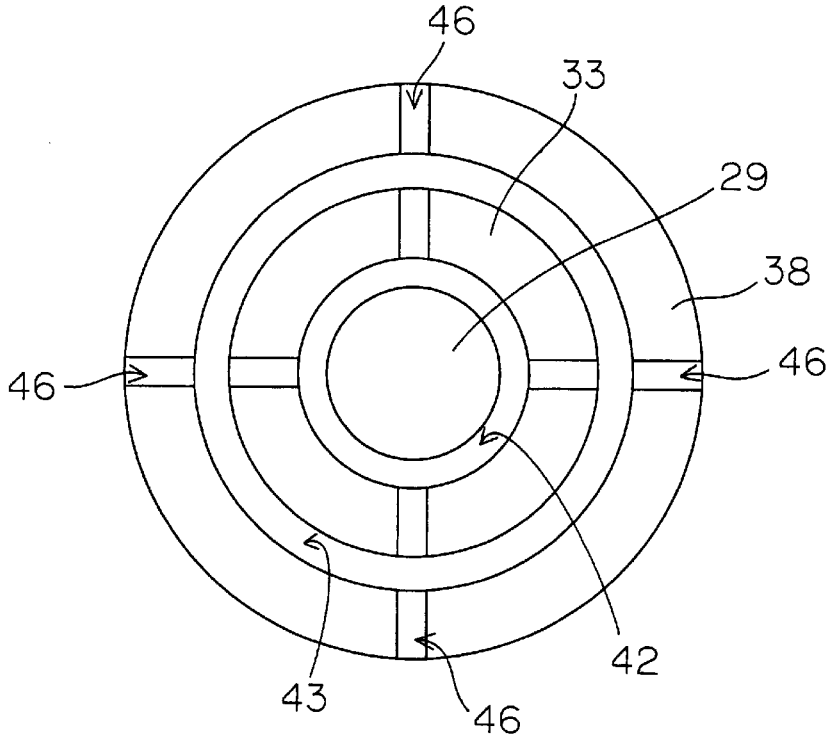
FIG. 3 is a plan view of an abrasive pad according to a first modification.
Figure 4:
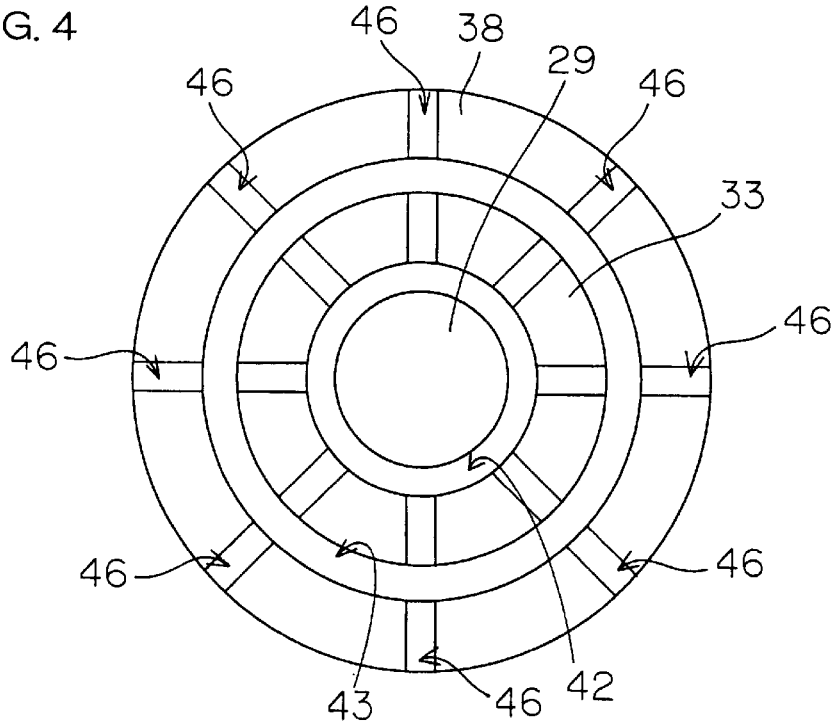
FIG. 4 is a plan view of an abrasive pad according to a second modification.

The abrasive pads 29, 33, 38 may each be unitary or divided into a plurality of sections. For example, the abrasive pads 33, 38 may each be divided into four sections by forming grooves 46 in a cross shape in the abrasive pads 33, 38 as shown in FIG. 3. Further, the abrasive pads 33, 38 may each be divided into a greater number of sections by forming a greater number of grooves 46 in the abrasive pads 33, 38 as shown in FIG. 4.

Figure 5:
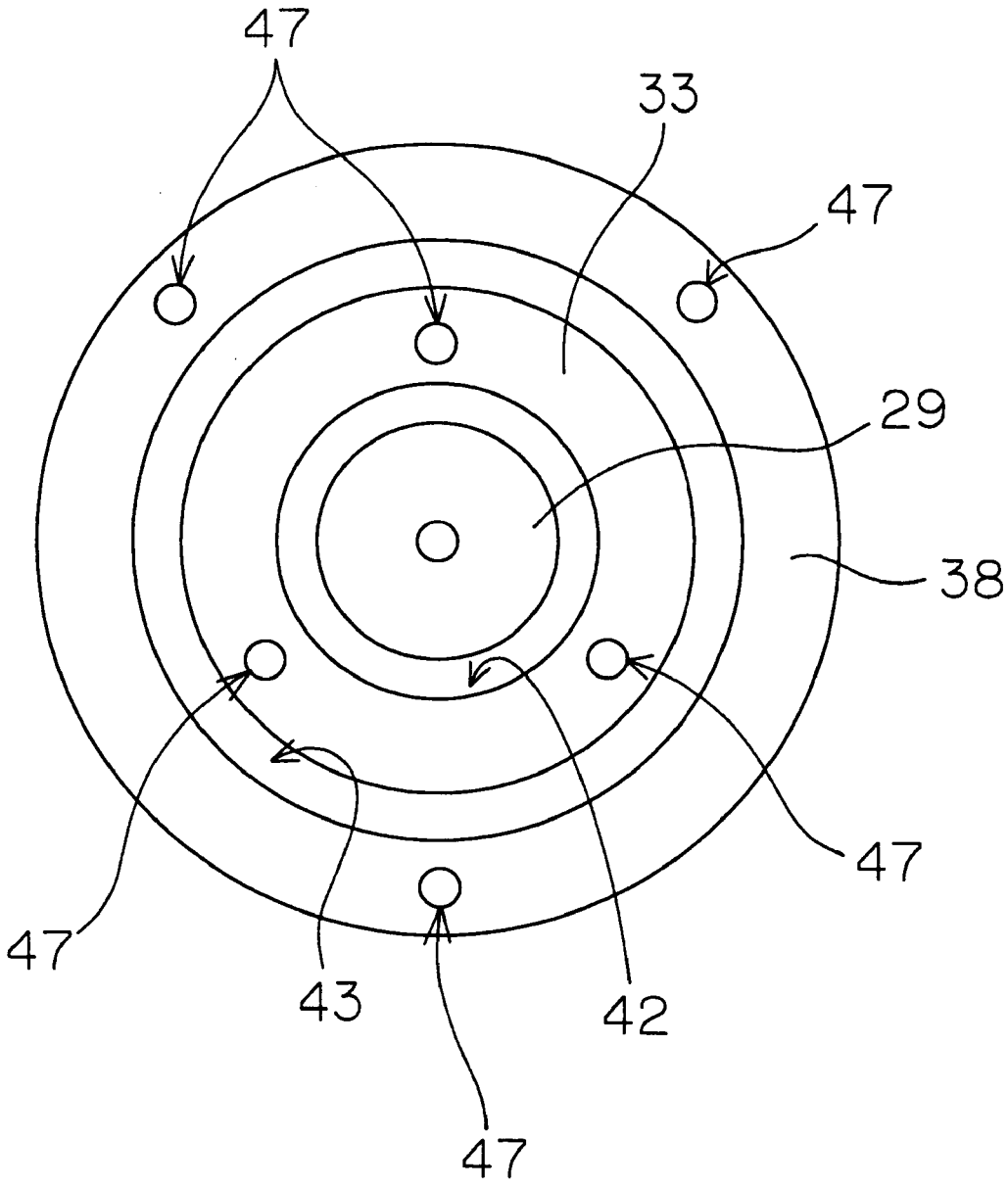
FIG. 5 is a plan view of an abrasive pad according to a third modification.
Figure 6:
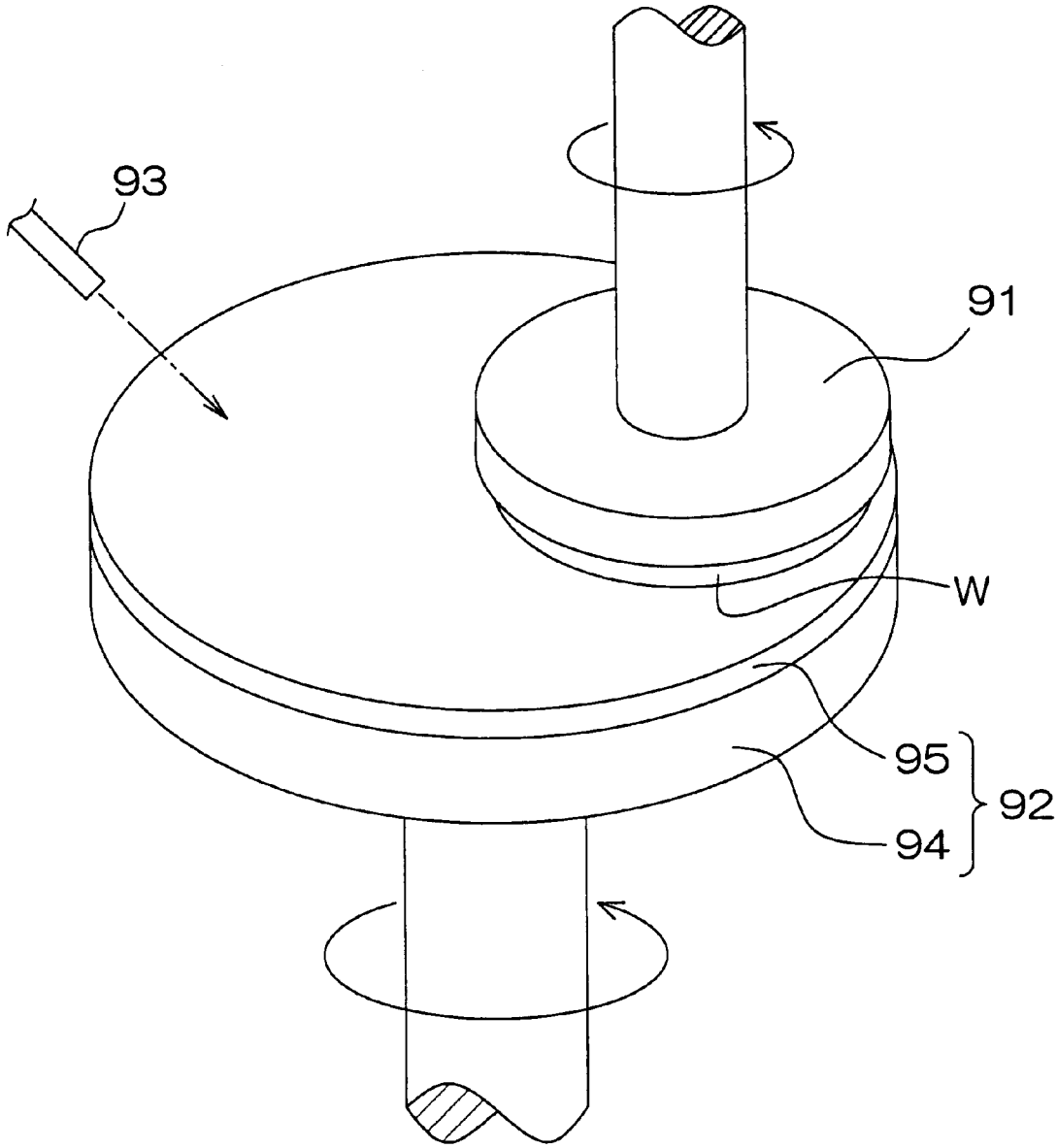
FIG. 6 is a diagram schematically illustrating the construction of a polishing machine according to the prior art.

It is preferred that recesses 47 for retaining the abrasive agent are formed in the surfaces of the abrasive pads 29, 33, 38 as shown in FIG. 5. With the provision of the recesses 47, parts of the abrasive agent supplied onto the surfaces of the abrasive pads 29, 33, 38 can be retained in the recesses 47 so as to be used for the polishing operation.

While one embodiment of the present invention and several modifications thereof have thus been described, the invention can be embodied in any other ways. In the embodiment described above, the rotation speeds and rotational directions of the abrasive pads 29, 33, 38 are individually controlled, but pressures to be applied onto the wafer W by the abrasive pads 29, 33, 38 may also individually be controlled for the uniform polishing of the surface of the wafer W by additionally providing a mechanism for moving up and down the abrasive pads 29, 33, 38 (the rotatable center portion 13, the first rotatable ring portion 14 and the second rotatable ring portion 15) by given distances. The individual control of the pressures to be applied onto the wafer W by the abrasive pads 29, 33, 38 and the individual control of the rotation speeds and rotational directions of the abrasive pads 29, 33, 38 may be employed in combination for the uniform polishing of the surface of the wafer W.

In the embodiment described above, the supply of the abrasive agent onto the abrasive pads 29, 33, 38 is achieved through the abrasive agent supply pipes 40, 41 extending through the first stationary cylinder 31 and the second stationary cylinder 36, but may be achieved, for example, with the use of a nozzle provided diagonally above the polishing base 12.

Although the polishing base 12 includes the rotatable center portion 13, the first rotatable ring portion 14 and the second rotatable ring portion 15 in the embodiment described above, the polishing base 12 may include only the rotatable center portion 13 and the first rotatable ring portion 14 or may further include a third rotatable ring portion surrounding the second rotatable ring portion 15. Further, the polishing base 12 may include the rotatable center portion and four or more rotatable ring portions.

Although the polishing machine according to the aforesaid embodiment is of a type in which the abrasive pads 29, 33, 38 are rotated or swung, the invention is applicable to a polishing machine of a belt type in which a surface of a workpiece is polished by an abrasive belt running in press contact with the surface of the workpiece. In this case, the abrasive belt is divided into a plurality of sections, and the running speeds of the respective sections of the abrasive belt are individually controlled for the uniform polishing of the workpiece.

The embodiment described above is directed to a case where the surface of the wafer W is chemically and mechanically polished, but the present invention is applicable not only to the chemical mechanical polishing (CMP) machine but also to a mechanical polishing machine for mechanically polishing a surface of a wafer. In this case, the provision of the abrasive agent supply pipes 40, 41 for supplying the abrasive agent onto the abrasive pads 29, 33, 38 can be obviated.

Further, the present invention is applicable not only to the wafer polishing machine but also to polishing machines for polishing any of various workpieces including substrates such as glass substrates for display panels, e.g., liquid crystal panels and EL (electroluminescence) panels.

While the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

This application corresponds to Japanese Patent Application No. 11-350463 filed to the Japanese Patent Office on Dec. 9, 1999, the disclosure thereof being incorporated herein by reference.

What is claimed is:

1. A polishing machine comprising:

a plurality of bases operative independently of each other;

a plurality of abrasive pads respectively fixed to the plurality of bases and each having an abrasive surface, said plurality of abrasive pads being arranged for polishing a workpiece by pressing the workpiece onto the abrasive surfaces of at least two of the plurality of abrasive pads simultaneously; and a base driving mechanism for individually operating the plurality of bases.

2. A polishing machine as set forth in claim 1, further comprising a control circuit for controlling the base driving mechanism so as to individually control operations of the respective bases.

3. A polishing machine as set forth in claim 2, wherein the control circuit controls the base driving mechanism so that the workpiece is generally uniformly polished by the abrasive surfaces of the respective abrasive pads.

4. A polishing machine as set forth in claim 1, wherein the plurality of abrasive pads include a central abrasive pad fixed to one of the bases and adapted to be rotated or swung about a predetermined rotation axis, and a ring abrasive pad fixed to the other base as surrounding the central abrasive pad and adapted to be rotated or swung about the predetermined rotation axis.

5. A polishing machine as set forth in claim 4, wherein the ring abrasive pad is circumferentially divided into a plurality of sections.

6. A polishing machine as set forth in claim 1, further comprising an abrasive agent supply mechanism for supplying an abrasive agent necessary for the polishing of the workpiece onto the abrasive surfaces of the abrasive pads.

7. A polishing machine as set forth in claim 6, wherein the abrasive agent supply mechanism supplies the abrasive agent onto the abrasive surfaces of the abrasive pads through a space between the plurality of abrasive pads.

8. A polishing machine as set forth in claim 7, wherein the abrasive surfaces of the abrasive pads are each formed with a recess for retaining the abrasive agent supplied from the abrasive agent supply mechanism.

9. A polishing machine comprising:

an abrasive pad divided into a center portion including a center of an abrasive surface for polishing a workpiece and a ring portion separate from and surrounding the center portion; and a driving mechanism for rotating the abrasive pad about an axis extending through the center of the abrasive surface with the abrasive surface kept in abutment against the workpiece.

10. A polishing machine as set forth in claim 9, further comprising an abrasive agent supply mechanism for supplying an abrasive agent necessary for the polishing of the workpiece onto the abrasive surface of the abrasive pad.

11. A polishing machine as set forth in claim 10, wherein the abrasive agent supply mechanism supplies the abrasive agent onto the abrasive surface of the abrasive pad through a space between the center portion and the ring portion.

12. A polishing machine as set forth in claim 11, wherein the abrasive surface of the abrasive pad is formed with a recess for retaining the abrasive agent supplied from the abrasive agent supply mechanism.

* * * * *